US006305571B1

(12) United States Patent
Chu

(10) Patent No.: US 6,305,571 B1
(45) Date of Patent: Oct. 23, 2001

(54) LID DEVICE WITH SPLASHLESS BAFFLE

(76) Inventor: Donny Chu, 4256 Knoll Ave., Oakland, CA (US) 94619

( * ) Notice: Subject to any disclaimer, the term of this patent is extended or adjusted under 35 U.S.C. 154(b) by 0 days.

(21) Appl. No.: 09/589,634

(22) Filed: Jun. 7, 2000

(51) Int. Cl.[7] ..... A47G 19/22

(52) U.S. Cl. ..... 220/719; 229/404; 222/424; 222/564; 222/571; 215/387; 220/713; 220/716; 220/254; 220/256

(58) Field of Search ..... 220/256, 711, 220/713, 719, 731, 780, 253, 254, 716, 718; 222/571, 564, 424; 229/404; 215/387

(56) References Cited

U.S. PATENT DOCUMENTS

| | | | | |
|---|---|---|---|---|
| Re. 31,650 | * | 8/1984 | Serritella | 229/404 |
| 3,360,160 | * | 12/1967 | Spencer | 220/719 |
| 3,360,161 | * | 12/1967 | Smith | 220/719 |
| 3,938,695 | * | 2/1976 | Ruff | 220/713 |
| 4,085,861 | * | 4/1978 | Ruff | 220/713 |
| 4,215,793 | * | 8/1980 | Packard | 220/712 |
| 4,322,014 | * | 3/1982 | Philip | 220/713 |
| 4,331,255 | * | 5/1982 | Fournier | 220/713 X |
| 4,394,928 | * | 7/1983 | Philip | 220/719 X |
| 4,433,800 | * | 2/1984 | Owens | 222/564 X |
| 4,589,569 | | 5/1986 | Clements . | |
| 4,619,372 | * | 10/1986 | McFarland | 220/713 |
| 4,842,165 | * | 6/1989 | Van Coney | 222/571 X |
| 4,890,770 | * | 1/1990 | Haga et al. | 222/571 X |
| 4,953,743 | * | 9/1990 | Dart et al. | 220/719 X |
| 4,991,747 | * | 2/1991 | Van Brocklin | 222/571 X |
| 5,143,248 | * | 9/1992 | Sawatsky | 220/253 X |
| 5,193,722 | * | 3/1993 | Groya et al. | 222/531 |
| 5,531,363 | * | 7/1996 | Gross et al. | 222/494 |
| 5,540,350 | * | 7/1996 | Lansky | 220/713 X |
| 5,601,203 | * | 2/1997 | Brun, Jr. | 220/253 |
| 5,792,654 | * | 8/1998 | Bohannon et al. | 220/253 X |
| 5,890,619 | * | 4/1999 | Belanger | 220/713 |
| 5,979,689 | * | 11/1999 | Lansky | 220/713 X |
| 5,988,426 | * | 11/1999 | Stern | 220/780 |
| 6,095,033 | * | 8/2000 | Melton | 220/718 X |

FOREIGN PATENT DOCUMENTS

| | | | | |
|---|---|---|---|---|
| 2053865 | * | 2/1991 | (GB) | 220/719 |

* cited by examiner

*Primary Examiner*—Allan N. Shoap
*Assistant Examiner*—Robin Hylton
(74) *Attorney, Agent, or Firm*—Beyer Weaver & Thomas, LLP

(57) ABSTRACT

A splashless lid device for dispensing fluid contained in a drinking container, wherein the container includes a lip portion which defines an opening into the container. A mounting portion is configured to sealingly engage the lip portion of the container and to be removable. A top cover is coupled to the mounting portion and extends substantially laterally across the container opening when the mounting portion is sealingly engaged with the container lip. The top cover includes a top wall and a bottom wall cooperating to define an interior cavity. The top wall has a drinking port in flow communication with the interior cavity. The bottom wall defines a baffle opening which extends into the interior cavity and is adapted to reduce splashing of fluid through the opening fluid dispensed from the container must pass through the baffle opening and into the interior cavity before passing through the drinking port.

42 Claims, 4 Drawing Sheets

LID DEVICE WITH SPLASHLESS BAFFLE

BACKGROUND OF THE INVENTION

1. Field of Invention

The present invention relates to lid devices for use in drinking cups. More specifically, the invention relates to lid devices for drinking containers which permit dispensing therefrom while minimizing splashing.

2. Description of the Prior Art

The fast food industry has experienced tremendous growth in the last several decades. While many fast food customers opt to consume their meals at the restaurants, just as often the food and beverages purchased are taken out. As our society becomes more mobile in nature, the "take-out" consumer sector may be increasing.

Consequently, new products directed toward this particular customer group are released periodically by the fast food industry. One example is the establishment of drive-through windows for the purchase of food while remaining seated in you automobile. Another example is the expansion of take-out beverages and other fast food items by gas service stations and mini-markets. Even traditional sit-down restaurants have expanded their menus to permit customers to purchase food-to-go.

Another area targeted by the fast food industry is the packaging of the food and/or beverages themselves. Of particular concern is the use of lid and container assemblies for hot beverages which have shown to create substantial hazards to the mobile consumer such as risks of skin burns and stained clothing. In fact, in the recent past, there have been several highly publicized accidents involving hot beverages.

Currently, hot beverages are disposed in a disposable container together with a snap-on lid device adapted to press-fit or interference fit onto an upper rim of the container. Generally, the lid device includes a top cover portion extending fully across the mouth of the container when it is mounted to the upper rim. An orifice or the like extends through the top cover portion to enable dispensing and access to the beverage through the lid device. Typical of these designs may be found in U.S. Pat. No. 4,589,569 to Clements.

One problem associated with these snap-on lid devices is that although such designs substantially reduce spillage, splashing of the hot beverage through the drinking orifice of the cover can still occur. In fact, even small jarring movements can result in splashing through the orifice and onto the user.

SUMMARY OF THE INVENTION

The present invention provides a splashless lid device for dispensing fluid contained in a drinking container. The lid device includes a mounting portion configured to sealingly engage a lip portion of the container for removable mounting thereto. A top cover is coupled to the mounting portion and extending substantially laterally across the container opening when the mounting portion is sealingly engaged with the container lip portion. The top cover includes a top wall and a bottom wall cooperating to define an interior cavity therebetween. The top wall includes a drinking port in flow communication with the interior cavity, and the bottom wall defines a baffle opening extending into the interior cavity. The baffle opening is adapted to reduce splash of fluid flow therethrough such that during fluid dispensing from the container, the fluid must pass through the baffle opening and into the interior cavity prior to passing through the drinking port.

This configuration, accordingly, substantially reduces splashing of the contained fluids from the drinking port even when the drinking container is jarred or jolted. This is performed by requiring fluids to first pass into the interior cavity through baffle openings before exiting through the drinking port, and then by orienting the longitudinal axis of the baffle opening generally perpendicular to the longitudinal axis of the drinking port.

In one embodiment, the bottom wall includes a drain port extending into the interior cavity to drain fluid contained therein when the container is oriented in an upright condition. The drain port is spaced-apart from and vertically lower than the baffle opening to induce gravity flow of the fluid therethrough. This arrangement is advantageous since a self-draining capability of the interior cavity is provided when the container is held upright. The interior cavity is sloped toward the drain hole, which is located in the bottom wall of the interior chamber at the periphery of the chamber but opposite in location from the drinking port.

In another embodiment, the splashless lid device may be provided by a top cover and a bottom cover which are press-fit together, and which cooperate to define the interior cavity. The lid device includes an alignment device aligning the position of the baffle opening proximate the drinking portion when the bottom cover is mounted to the top cover. The alignment device includes an alignment ridge and an alignment slot formed and dimensioned for aligned receipt of the alignment ridge therein. The alignment ridge extends upwardly from the bottom wall, while the alignment slot is defined in the top wall, and.

In another aspect of the present invention, a drinking container assembly for dispensing a fluid therefrom. The container assembly includes a container having a lip portion which defines an opening into the container. A splashless lid device is included having a mounting portion configured to sealingly engage the lip portion of the container for removable mounting thereto. A top cover is coupled to the mounting portion and extends substantially laterally across the container opening when the mounting portion is sealingly engaged with the container lip portion. The top cover includes a top wall and a bottom wall cooperating to define an interior cavity therebetween. The top wall has a drinking port in flow communication with the interior cavity, and the bottom wall defines a baffle opening extending into the interior cavity which is adapted to reduce splash of fluid flow therethrough. Thus, during fluid dispensing from the container, the fluid must pass through the baffle opening and into the interior cavity prior to passing through the drinking port.

BRIEF DESCRIPTION OF THE DRAWING

The assembly of the present invention has other objects and features of advantage which will be more readily apparent from the following description of the best mode of carrying out the invention and the appended claims, when taken in conjunction with the accompanying drawing, in which:

BEST MODE OF CARRYING OUT THE INVENTION

Figure 1:
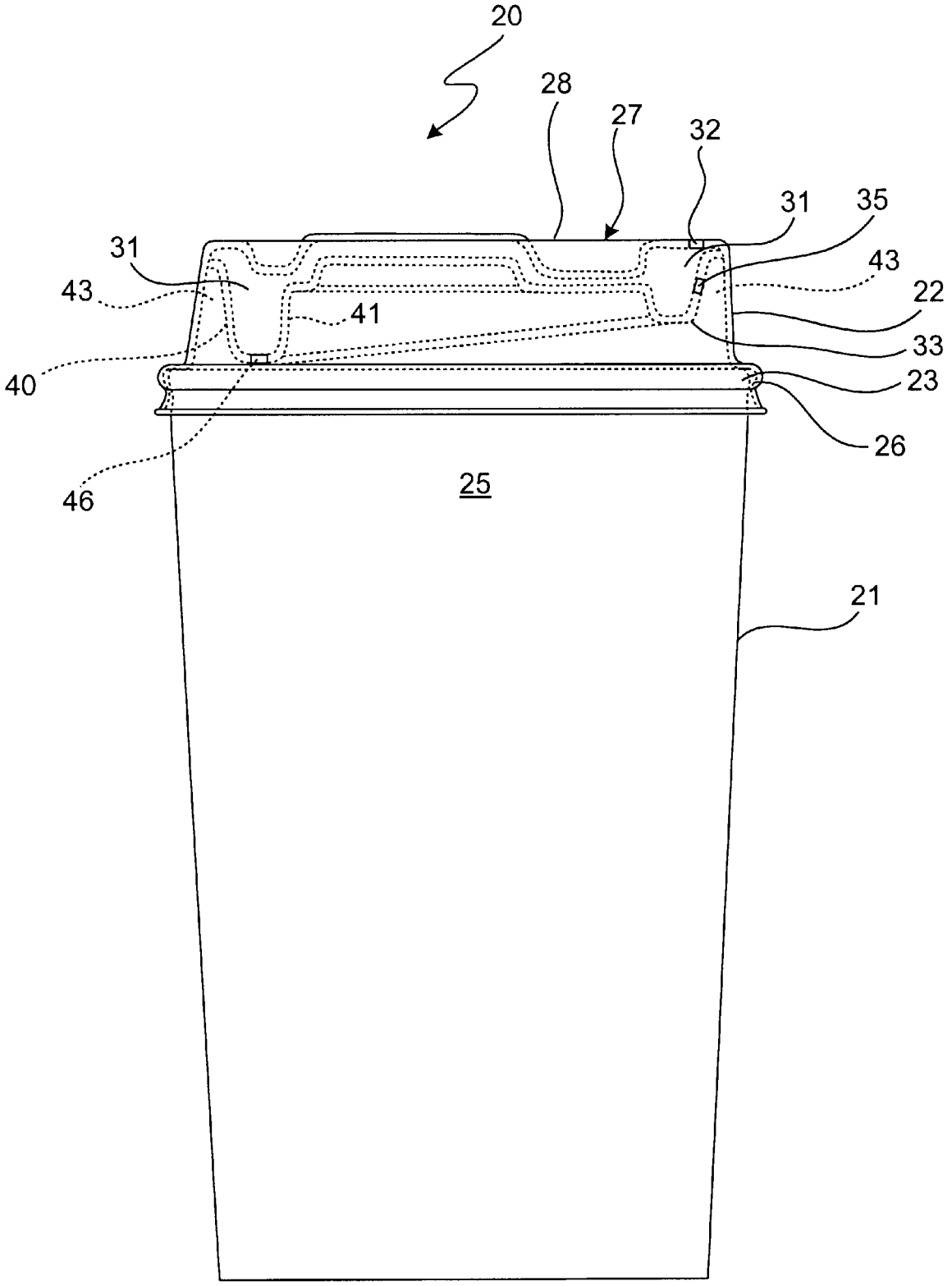
FIG. 1, is a side elevation view of a splashless lid device constructed in accordance with the present invention, mounted to a drinking container.
Figure 2:
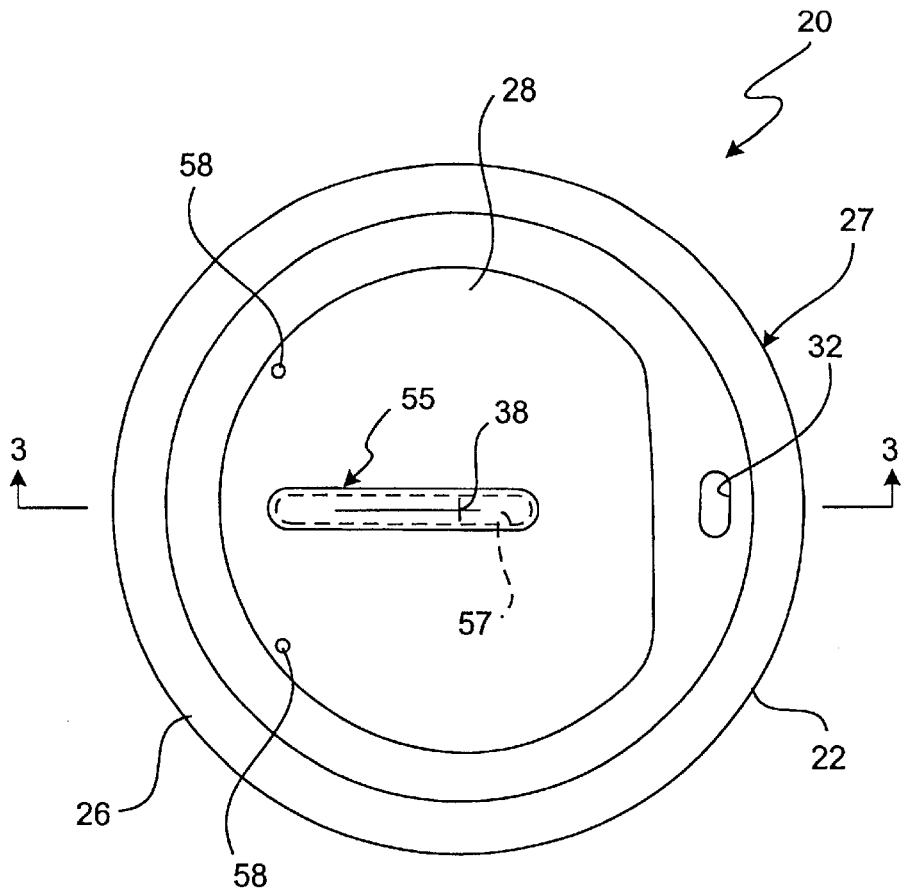
FIG. 2 is a top plan view of the splashless lid device of FIG. 1.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Attention is now directed to FIGS. 1–4 where a splashless lid device, generally designated 20, for dispensing fluid 19 contained in a container 21. The container, preferably in the form of a drinking cup 21, includes a generally upstanding, surrounding side wall 22 terminating at a lip portion 23 which defines an opening 25 into the cup. The lid device 20 includes a mounting portion 26 configured to sealingly engage the lip portion 23 of the cup 21. A top cover 27 is coupled to the mounting portion 26 and extends substantially laterally across the container opening 25. The top cover 27 includes a top wall 28 and a bottom wall 30 cooperating to define an interior cavity 31 therebetween. The top wall 28 further includes a drinking port 32 in flow communication with the interior cavity 31, while the bottom wall 30 includes a baffle portion 33 providing a baffle opening 35 extending into the interior cavity 31. The baffle opening 35 is adapted to reduce splash of the fluid therethrough such that during fluid dispensing from the cup, the fluid must pass through the baffle opening 35 and into the interior cavity 31 before passing through the drinking port 32.

Accordingly, this arrangement substantially prevents splashing of the fluid directly through drinking port 32 of the top wall 28 essentially by situating a baffle or the like upstream from the port. As best viewed in FIGS. 3 and 4, the fluid 19 must initially flow into the interior cavity of the lid device 20 through the baffle opening 35 prior to passing through the drinking port 32. This effectively minimizes direct line of sight loss of the fluid out of container 21 through the drinking port when minor jarring and jolting of the container occur while the container is positioned generally upright. Any sloshing of the fluid 19 in the container, while substantially upright, will cause the fluid to impinge upon the bottom wall 30, rather than out through the drinking port 32.

The mounting portion 26 of the lid device 20 includes an annular recess 36 formed and dimensioned for an interference with the upper lip portion 23 which defines an opening 25 into the container 21. Upon receipt of the upper lip portion 23 into the recess 36, a fluid-tight seal is effectively formed therebetween so that the fluid in the container 21 can be dispensed from the drinking port 32 without loss of fluid at this juncture. This conventional press-fit fastening arrangement is common in most disposable lid devices, and will not be described in further detail.

Figure 3:
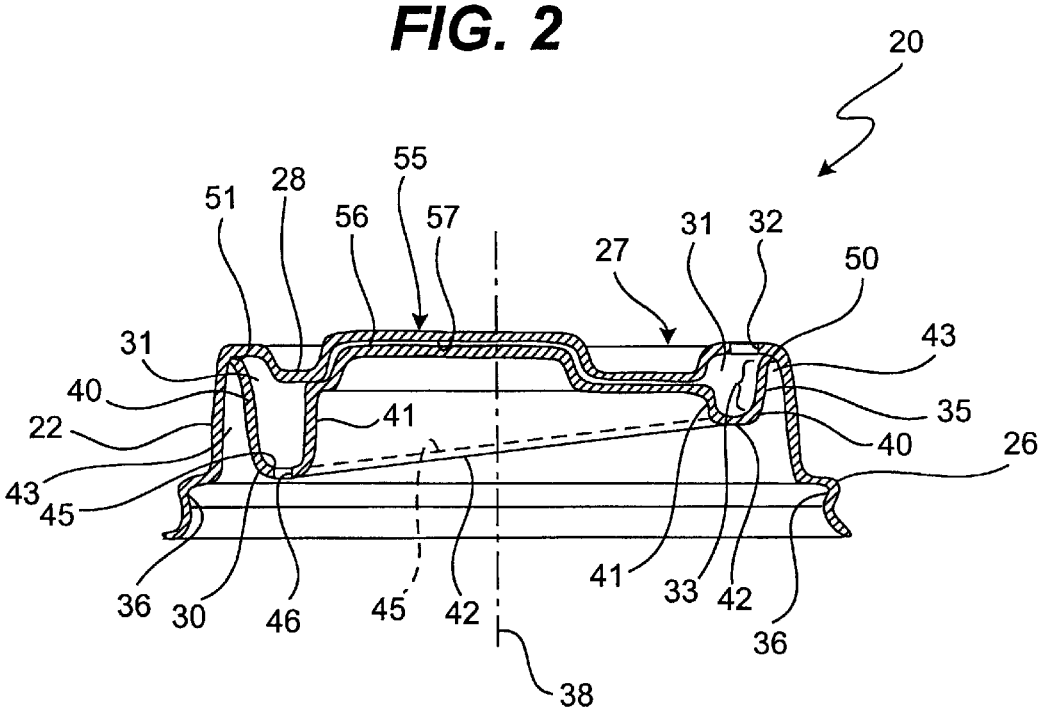
FIG. 3 is a side elevation view, in cross-section, of the lid device taken substantially along the plane of the line 3—3 in FIG. 2.
Figure 5:
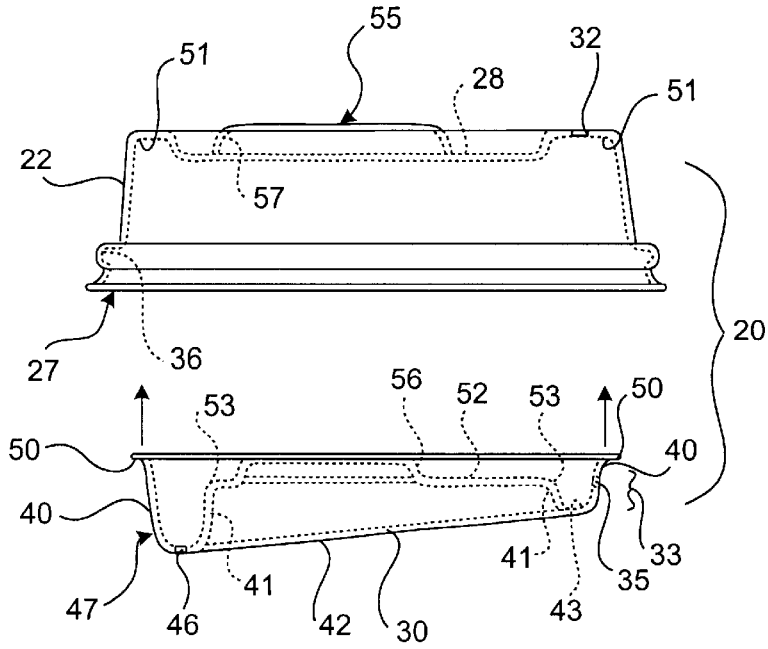
FIG. 5 is an exploded view of the splashless lid device of FIG. 1 illustrating a top cover portion and a mating bottom cover portion.

Referring now to FIGS. 3 and 5, an upstanding side wall 22 is illustrated spacing the top wall 28 a predetermined distance from the mounting portion 26. Preferably, this side wall 22 is annular-shaped, and is oriented substantially vertically. The peripheral edges of the top wall 28 are integrally coupled to the upper edge portion of the upstanding side wall to cover the container opening 25. Similar to conventional disposable lids, the drinking port 32 is oblong in shape, and is positioned on the top wall 28 substantially adjacent the side wall 22 of the top cover 27.

As above-indicated, an interior cavity 31 is formed between top wall 28 and the bottom wall 30 upon which the fluids contained in the container must pass into, via baffle openings 35, prior to being dispensed through drinking port 32. This interior cavity 31 is preferably in the shape of an annular cavity extending around the longitudinal axis 38 of the lid device 20 (FIG. 3). The bottom wall 30, further, is preferably U-shaped in the transverse cross-sectional dimension provided by a first wall portion 40, an opposed second wall portion 41, and an annular bight portion 42 therebetween. The first wall portion 40 is annular in shape and depends downwardly from the top wall 28 in a direction generally diverging away from the upstanding side wall 22. These two diverging walls form an inverted V-shaped, annular channel 43 therebetween. Similarly, the second wall portion 41 is annular and depends downwardly from the top wall 28 toward the bight portion 42 of the bottom wall 30. Collectively, the first wall portion 40, the second wall portion 41 and an annular floor 45 of the bight portion 42 define the annular cavity 31 extending generally along the circumferential edge of the circular bottom wall 30.

The bottom wall 30 includes the baffle portion 33 which provides the baffle opening 35 therethrough proximate the drinking port 32. As best viewed in FIGS. 5 and 6, the baffle opening 35 is located in the downward projecting first wall portion 40. In this arrangement, the longitudinal axes of the baffle opening 35 is generally perpendicular to that that of the drinking port 32, and to the surface of the fluid in the held in the container 21 when oriented in the upright condition. Consequently, any direct line of sight loss of the fluid out of container 21 through the drinking port 32 is substantially minimized. The baffle opening 35 is accessible from the annular channel 43 proximate to the drinking port 32 Fluid 19 entering opening 35 might initially be deflected by the sidewall 22. Since drinking port 32 is positioned at the top surface of the interior cavity 31, this fluid 19 would likely be deflected horizontally into the interior cavity, rather than vertically toward the drinking port.

Figure 4:
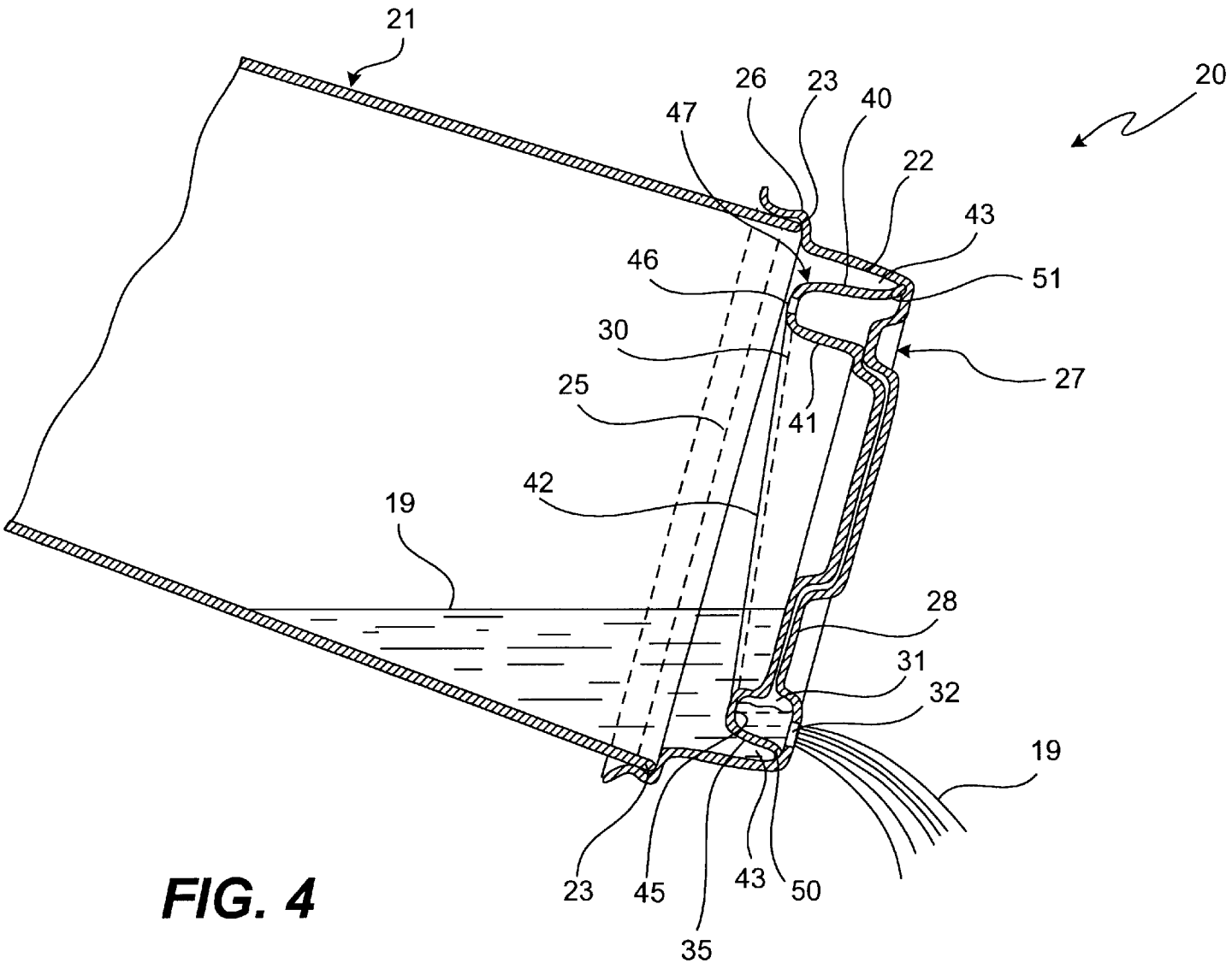
FIG. 4 is a side elevation view of a splashless lid device of FIG. 3 mounted to the drinking container, and tilted to dispense liquid from a drinking port thereof.

To dispense the fluid from the drinking port 32, once the container 21 is tilted by a sufficient amount, as viewed in FIG. 4, the fluid 19 in the annular channel 43 is funneled or channeled toward the baffle openings 35 and into the interior or annular cavity 31 of the lid device 20. When a sufficient amount of fluid 19 enters the interior cavity, it will then be dispensed through the drinking port 32.

Figure 6:
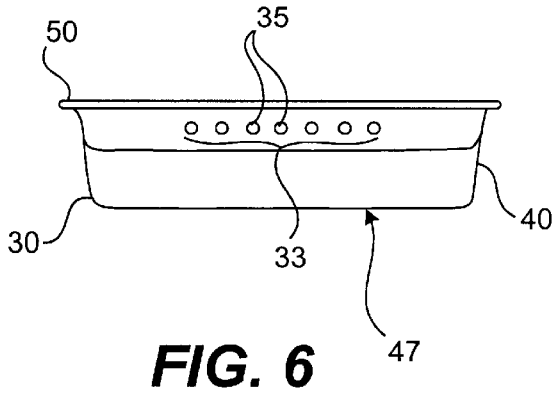
FIG. 6 is a front elevation view of the bottom cover portion of FIG. 5 showing a plurality of baffle orifices extending therethrough.

In the preferred form, the baffle opening 35 may be comprised a plurality of orifices 35 situated along the first wall portion 40 proximate the drinking port 32 (FIG. 6). The number and diameter of the orifices 35 can be customized to control the rate of flow into the interior cavity 31, and hence through the drinking port 32, when tilted to dispense the fluid 19. On the other hand, the smaller the diameter of the orifices 35, the greater the baffle control. Thus, to maintain a higher flow rate while increasing the baffle control, it may be desirable to minimize the orifice diameter while increasing the number of orifices. Preferably, however, the diameter of the orifices are in the range of about 1/64 inches to about 1/16 inches.

Figure 7:
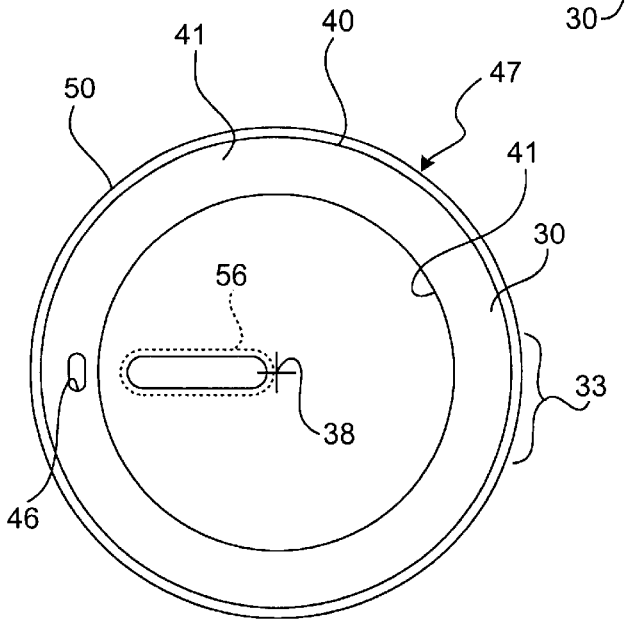
FIG. 7 is a bottom plan view of the bottom cover portion of FIG. 5.

In accordance with another aspect of the present invention, the lid device is adapted to gravity drain any fluid remaining in the interior cavity 31 out through a drain port 46 when the container is repositioned back upright. FIGS. 3, 5 and 7 best illustrate that the floor 45 of the bottom wall 30 is tilted or slanted by a sufficient amount in a manner causing gravity flow of the fluid in the interior cavity 31 toward the drain port 46. Preferably, the floor is slanted at an angle between about 5° to about 20° from a horizontal plane, when the container is positioned in the upright position of FIG. 1.

The drain port 46 is preferably located at the lowest vertical point of the floor 45, and lower than the location of any orifices of baffle opening 35. More preferably, the drain port 46 is positioned on an opposite side of the annular cavity 31 than that of the plurality of drinking port 32. Consequently, any fluids 19 entering into the annular cavity 31 through the relatively large drain port 46 will not have a direct line of sight passage to the drinking port 32 situated at the other end. Hence, normal jostling will not cause loss of fluid from the drain port 46 through the drinking port 32. It will be understood, however, that this drain port could be located at other locations along the bight portion 42 provided the drain port is out of the direct line of sight, and is positioned a sufficient distance from the drinking port.

Referring now to FIGS. 5–7, it is shown that the top cover 27 and a bottom cover 47 of the lid device 20 are preferably provided by two independent structures configured to mate with one another in a snap-fit manner. In this construction, the annular first wall portion 40 terminates at an outer peripheral rim portion 50 which bows outwardly. This annular rim portion 50 is formed and dimensioned to seat, in the interior crease 51 formed between the upstanding side wall 22 and the top wall 28. Thus, the diameter of the outer rim portion 50 is sized to be slightly larger than the diameter of the interior crease 51 of the top cover 27. Upon a press fit or interference fit of the rim portion 50 into the interior crease 51, the rim portion 50 is compressed radially inwardly by contact with the top cover 27. Thus, the outer rim portion 50 will be biased outwardly to secure the bottom cover to the top cover.

To increase the structural integrity of the bottom cover 30, a support wall 52 is provided joining the inner rim portions 53 of the second wall portion 41 thereof. This support wall 52 is integrally formed with the second wall portion 41 to form a single piece. Both the top cover 27 and bottom cover 47 are composed of a flexible polymer material such as high impact styrene and other plastics. This material is of low cost, and is easily injection molded or vacuum formed. It is recognized, however, that the lid device may be constructed with other materials in other embodiments including more rigid plastics.

When mounting the bottom cover 47 to the top cover 27, as above-mentioned, it is important to align the baffle openings 35 in an orientation near the drinking port 32. This is best performed by providing an alignment device 55 aligning the position of the baffle opening proximate the drinking port when the bottom wall is mounted to the top wall. As best viewed in FIGS. 3 and 5, the alignment device 55 includes an elongated alignment ridge 56 extending upwardly from the support wall 52 toward the top wall 28 of the top cover 27. This ridge 56 is formed and dimensioned for aligned receipt in a corresponding elongated alignment slot 57 provided in the top wall 28 of the top cover 27. Upon proper alignment between the alignment ridge 56 with the elongated alignment slot 57, the bottom cover can be snap-fit together with the top cover 27 for use thereof as above-mentioned.

In the preferred embodiment, the alignment ridge 56 and corresponding alignment slot 57 are slightly off-set from the longitudinal axis 38 of the lid device 20. This arrangement assures proper rotational alignment between the top cover 27 and the bottom cover 47 during assembly. It will be appreciated, however, that this alignment operation can also be performed in other ways such as configuring the alignment slot and the corresponding ridge to only mate in one directional manner. Moreover, the alignment ridge and slot need not be elongated, and may be in any shape such as a nub or the like. Finally, it will be understood that the alignment ridge could, in other embodiments, project downward from the underside of the top cover and mate with a slot formed in the bottom cover.

In another embodiment, one or more vent holes 58 may be provided in top cover 27 to provide venting for the annular interior cavity 31 during fluid dispensing. These holes 58 extend through the top wall 28 into the interior cavity 31 and may be spaced-apart from the drain port 46 and the drinking port 32 to reduce or minimize passage of fluid accelerating in a vertical direction from the drain port 46.

What is claimed is:

1. A splashless lid device for dispensing fluid contained in a drinking container, the container including a lip portion which defines an opening into the container, said lid device comprising:

a mounting portion configured to sealingly engage the lip portion of the container for removable mounting thereto; and a top cover coupled to the mounting portion and extending substantially laterally across the container opening when the mounting portion is sealingly engaged with the container lip portion, said top cover including a top wall and a bottom wall cooperating to define an interior cavity therebetween, said top wall having a drinking port in flow communication with said interior cavity, and said bottom wall having an annular first wall portion depending downwardly from said top wall and having a baffle opening extending into said interior cavity proximate the drinking port such that an axis of said baffle opening is substantially skewed relative to an axis of said drinking port, the downwardly depending baffle portion being adapted to reduce splash of fluid flow therethrough such that during fluid dispensing from the container, said fluid must pass through the baffle opening and into said interior cavity prior to passing through said drinking port.

2. The splashless lid device according to claim 1, wherein said baffle opening includes a plurality of orifices.

3. The splashless lid device according to claim 2, wherein said orifices have a diameter in the range of about 1/64 inches to about 1/16 inches.

4. The splashless lid device according to claim 1, wherein said drinking port is positioned proximate to the periphery of the top cover and adjacent the container lip portion when said lid device is mounted to the container.

5. The splashless lid device according to claim 1, further including:

an upstanding side wall extending axially between the mounting portion and the top cover, said side wall and said bottom wall cooperating to channel the fluid through the baffle opening during the fluid dispensing from the container.

6. The splashless lid device according to claim 5, wherein said baffle opening includes a plurality of orifices.

7. The splashless lid device according to claim 6, wherein said plurality of orifices are positioned proximate said drinking port, and facing opposite said side wall.

8. The splashless lid device according to claim 5, wherein said bottom wall further depends downwardly from and circumferentially about said top wall proximate the periphery thereof, and generally opposed and spaced-apart from the side wall to define an annular channel to channel said fluid through the baffle opening during the fluid dispensing from the container.

9. The splashless lid device according to claim 8, wherein said bottom wall further including a drain port extending into said interior cavity to drain fluid contained therein when the container is oriented in an upright condition, said drain port being spaced-apart from and vertically lower than said baffle opening to induce gravity flow of the fluid therethrough.

10. The splashless lid device according to claim 9, wherein said bottom wall includes a floor defining a portion of the interior cavity and adapted to channel fluid contained therein toward the drain port when the container is oriented in the upright condition.

11. The splashless lid device according to claim 10, wherein said interior cavity is annular-shaped.

12. The splashless lid device according to claim 11, wherein said drain port is positioned along the floor on one side of the annular-shaped interior cavity opposite the baffle openings.

13. The splashless lid device according to claim 1, wherein said bottom wall further including a drain port extending into said interior cavity to drain fluid contained therein when the container is oriented in an upright condition, said drain port being spaced-apart from and vertically lower than said baffle opening to induce gravity flow of the fluid therethrough.

14. The splashless lid device according to claim 1, wherein a longitudinal axis of said baffle opening is oriented generally perpendicular to a longitudinal axis of said drinking port.

15. The splashless lid device according to claim 1, wherein a longitudinal axis of said baffle opening is oriented generally perpendicular to a longitudinal axis of said drinking port.

16. A splashless lid device for dispensing fluid contained in a drinking container, the container including an upper lip portion which defines an opening into the container, said lid device comprising:

a top cover having a mounting portion configured to sealingly engage the lip portion of the container for removable mounting thereto, and a top wall coupled to the mounting portion and extending substantially laterally across the container opening when the mounting portion is sealingly engaged with the container lip portion; and a bottom cover adapted to removably mount to said top cover such that said top wall and a bottom wall of the bottom cover cooperate to define an interior cavity therebetween, said top wall having a drinking port in flow communication with said interior cavity, and said bottom wall having an annular first wall portion depending downwardly from said top wall and having a baffle opening extending into said interior cavity such that an axis of said baffle opening is substantially skewed relative to an axis of said drinking port, the downwardly depending baffle portion being adapted to reduce splash of fluid flow therethrough such that during fluid dispensing from the container, said fluid must pass through the baffle opening and into said interior cavity prior to passing through said drinking port.

17. The splashless lid device according to claim 16, wherein said bottom cover is adapted to press-fit into said top cover.

18. The splashless lid device according to claim 16, wherein said baffle opening includes a plurality of orifices.

19. The splashless lid device according to claim 16, further including:

an alignment device aligning the position of the baffle opening proximate said drinking portion when the bottom cover is mounted to the top cover.

20. The splashless lid device according to claim 19, wherein said alignment device includes an alignment ridge extending from one of the top wall and the bottom wall, and an alignment slot defined by the other of the bottom wall and the top wall, and formed and dimensioned for aligned receipt of the alignment ridge therein.

21. The splashless lid device according to claim 16, further including:

an upstanding side wall extending axially between the mounting portion and the top wall, said side wall and said bottom wall cooperating to channel the fluid through the baffle opening during the fluid dispensing from the container.

22. The splashless lid device according to claim 21, wherein said baffle opening includes a plurality of orifices.

23. The splashless lid device according to claim 21, wherein said bottom wall is U-shaped, and said plurality of orifices are positioned along the U-shaped wall facing opposite said side wall.

24. The splashless lid device according to claim 21, wherein said bottom wall depends downwardly from and circumferentially about said top wall proximate the periphery thereof, and generally opposed and spaced-apart from the side wall to define an annular channel to channel said fluid through the baffle opening during the fluid dispensing from the container.

25. The splashless lid device according to claim 24, wherein said bottom wall further including a drain port extending into said interior cavity to drain fluid contained therein when the container is oriented in an upright condition, said drain port being spaced-apart from and vertically lower than said baffle opening to induce gravity flow of the fluid therethrough.

26. The splashless lid device according to claim 25, wherein said bottom wall is U-shaped forming an annular interior cavity extending circumferentially proximate the periphery of the top wall.

27. The splashless lid device according to claim 26, wherein an outer rim portion of the U-shaped bottom wall is adapted to press-fit into said top cover.

28. The splashless lid device according to claim 27, wherein said bottom wall includes a floor defining a portion of the interior cavity adapted to channel fluid contained therein toward the drain port.

29. The splashless lid device according to claim 16, wherein said bottom wall includes a floor defining a portion of the interior cavity, and is adapted to channel fluid contained therein toward a drain port when the container is oriented in the upright condition.

30. A drinking container assembly for dispensing a fluid therefrom comprising:

a container including a lip portion which defines an opening into the container; and a splashless lid device having a mounting portion configured to sealingly engage the lip portion of the container for removable mounting thereto, and a top cover coupled to the mounting portion and extending substantially laterally across the container opening when the mounting portion is sealingly engaged with the container lip portion, said top cover including a top wall and a bottom wall cooperating to define an interior cavity therebetween, said top wall having a drinking port in flow communication with said interior cavity, and said bottom wall having an annular first wall portion depending downwardly from said top wall and having a baffle opening extending into said interior cavity such that an axis of said baffle opening is substantially skewed relative to an axis of said drinking port, the downwardly depending baffle portion being adapted to reduce splash of fluid flow therethrough such that during fluid dispensing from the container, said fluid must pass through the baffle opening and into said interior cavity prior to passing through said drinking port.

31. The container assembly according to claim 30, wherein a longitudinal axis of said baffle opening is oriented generally perpendicular to a longitudinal axis of said drinking port.

32. The container assembly according to claim 31, wherein said bottom wall further including a drain port extending into said interior cavity to drain fluid contained therein when the container is oriented in an upright condition, said drain port being spaced-apart from and vertically lower than said baffle opening to induce gravity flow of the fluid therethrough.

33. A splashless lid device for dispensing fluid contained in a drinking container, the container including a lip portion which defines an opening into the container, said lid device comprising:

a mounting portion configured to sealingly engage the lip portion of the container for removable mounting thereto; and a top cover extending substantially laterally across the container opening when the mounting portion is sealingly engaged with the container lip portion, said top cover including a top wall and a bottom wall cooperating to define an interior cavity therebetween, said top wall having a drinking port in flow communication with said interior cavity, and said bottom wall depending downwardly from the top wall and having a baffle opening extending into said interior cavity and adapted to reduce splash of fluid flow therethrough; and the top cover includes an upstanding side wall extending between and interconnecting the mounting portion and the top wall, said side wall and said bottom wall cooperating to channel the fluid through the baffle opening such that during fluid dispensing from the container, said fluid must pass through the baffle opening and into said interior cavity prior to passing through said drinking port.

34. The splashless lid device according to claim 33, wherein said bottom wall depends downwardly from and circumferentially about said top wall proximate the periphery thereof, and generally opposed and spaced-apart from the side wall to define an annular channel to channel said fluid through the baffle opening during the fluid dispensing from the container.

35. The splashless lid device according to claim 34, wherein said bottom wall further including a drain port extending into said interior cavity to drain fluid contained therein when the container is oriented in an upright condition, said drain port being spaced-apart from and vertically lower than said baffle opening to induce gravity flow of the fluid therethrough.

36. The splashless lid device according to claim 35, wherein said bottom wall includes a floor defining a portion of the interior cavity and adapted to channel fluid contained therein toward the drain port when the container is oriented in the upright condition.

37. The splashless lid device according to claim 36, wherein said interior cavity is annular-shaped.

38. A splashless lid device for dispensing fluid contained in a drinking container, said container including an upper lip portion which defines an opening into the container, said lid device comprising:

a top cover having a mounting portion configured to sealingly engage the lip portion of the container for removable mounting thereto, a top wall extending substantially laterally across the container opening when the mounting portion is sealingly engaged with the container lip portion, and an upstanding side wall extending between and interconnecting the mounting portion and the top wall; and a bottom cover adapted to removably mount to said top cover such that said top wall and a bottom wall of the bottom cover cooperate to define an interior cavity therebetween, said top wall having a drinking port in flow communication with said interior cavity, and said bottom wall depending downwardly from the top wall and having a baffle opening extending into said interior cavity, and adapted to reduce splash of fluid flow therethrough, said side wall and said bottom wall cooperating to channel the fluid through the baffle opening such that during fluid dispensing from the container, said fluid must pass through the baffle opening and into said interior cavity prior to passing through said drinking port.

39. The splashless lid device according to claim 38, wherein said bottom cover is adapted to press-fit into said top cover.

40. The splashless lid device according to claim 38, wherein said bottom wall depends downwardly from and circumferentially about said top wall proximate the periphery thereof, and generally opposed and spaced-apart from the side wall to define an annular channel to channel said fluid through the baffle opening during the fluid dispensing from the container.

41. The splashless lid device according to claim 40, wherein said bottom wall further including a drain port extending into said interior cavity to drain fluid contained therein when the container is oriented in an upright condition, said drain port being spaced-apart from and vertically lower than said baffle opening to induce gravity flow of the fluid therethrough.

42. The splashless lid device according to claim 38, wherein said bottom wall is U-shaped forming an annular interior cavity extending circumferentially proximate the periphery of the top wall.

* * * * *